United States Patent [19]

Feddeler

[11] 4,372,611

[45] Feb. 8, 1983

[54] SEAT WITH ADJUSTABLE BACK

[75] Inventor: Lester H. Feddeler, Elk Grove Village, Ill.

[73] Assignee: Coach and Car Equipment Corporation, Elk Grove Village, Ill.

[21] Appl. No.: 211,373

[22] Filed: Nov. 28, 1980

[51] Int. Cl.[3] ..... A47C 1/025

[52] U.S. Cl. ..... 297/371; 297/369

[58] Field of Search ..... 297/370, 371, 366, 328, 297/355, 368, 369, 367

[56] References Cited

U.S. PATENT DOCUMENTS

| | | | |
|---|---|---|---|
| 586,432 | 7/1897 | Gower . | |
| 601,575 | 3/1898 | Magee . | |
| 1,046,693 | 12/1912 | Walton . | |
| 1,173,829 | 2/1916 | Mangam . | |
| 1,821,429 | 11/1926 | Ferreira . | |
| 2,130,782 | 9/1938 | Willoughby | 297/367 |
| 2,143,634 | 1/1939 | Saunders | 297/328 |
| 2,809,691 | 10/1957 | Norwood et al. | 297/369 |
| 4,168,050 | 9/1979 | Nerem et al. | 297/328 X |

*Primary Examiner*—William E. Lyddane

*Attorney, Agent, or Firm*—Merriam, Marshall & Bicknell

[57] ABSTRACT

A seat having a back frame pivotally mounted on a seat frame for tilting the back frame relative to the seat frame and latching structure for locking the back frame in any one of several tilted positions. The latching structure comprises a notched plate pivotally mounted below the seat frame and notch-engaging means connected to and pivotable with the back frame.

4 Claims, 9 Drawing Figures

SEAT WITH ADJUSTABLE BACK

BACKGROUND OF THE INVENTION

The present invention relates generally to seats and more particularly to seats with tilting backs which may be adjusted to and locked in any one of several tilted positions.

Seats of the type to which the present invention relates are intended for use by vehicle operators, such as locomotive engineers. In order to lock the tilting seat back into any one of a plurality of tilted positions, such seats typically utilize a pair of latching elements, one of which has a plurality of notches and the other of which comprises means for individually engaging the notches in the one element. A first of the two latching elements is normally attached to the seat frame and the second is normally attached to the back frame which in turn is pivotally mounted relative to the seat frame.

It is desirable that seats having tilting backs of this type be of sturdy construction and be relatively free from wiggling when locked into any one of the tilted positions.

SUMMARY OF THE INVENTION

A seat with an adjustable tilting back constructed in accordance with the present invention has all of the desirable features described above. The seat comprises a substantially horizontally disposed seat frame having front and rear ends and a substantially vertically disposed back frame having top and bottom ends. The back frame is pivotally connected, adjacent its bottom end, to the seat frame adjacent the rear end of the latter. This connection mounts the back frame for movement about a first horizontal, pivotal axis extending from side to side on the seat. Extending forwardly from the back frame, adjacent the bottom end thereof, is at least one elongated member which terminates at a forward end or portion located in front of the first horizontal pivotal axis.

The locking structure for the tilting seat back comprises at least one latch plate having upper and lower ends and a plurality of notches therebetween. Each latch plate is pivotally connected, adjacent its upper end, to the seat frame forwardly of the first horizontal pivotal axis. This pivotal connection mounts the latch plate for movement about a second horizontal pivotal axis extending from side to side on the seat.

At the forward end of the member extending from the back frame is an element including means for individually engaging the notches on the latch plate. This engagement locks the back frame against pivotal movement about the first horizontal pivotal axis.

The locking structure also includes means, such as a coil spring, which normally urges the latch plate towards the forward end of the aforementioned member to releasably engage an individual notch in the plate with the notch-engaging means at the forward end of that member. This reduces wiggle when the notch-engaging means is engaged within one of the notches. Wiggle can also be reduced by tapering either the notches or the notch-engaging element.

The locking structure can be unlocked, to permit adjustment of the seat back from one tilted position to another, merely by manually pivoting the latch plate away from the notch-engaging element on the forwardly extending member to disengage the two, thereby permitting pivotal adjustment of the back frame relative to the seat frame. Once a desired tilted position has been attained, the seat back can be locked in that position merely by releasing the latch plate which is normally urged into a position in which an appropriate notch thereon is engaged by the notch-engaging means on the forwardly extending member attached to the back frame.

Other features and advantages are inherent in the structure claimed and disclosed or will become apparent to those skilled in the art from the following detailed description in conjunction with the accompanying diagrammatic drawings.

DETAILED DESCRIPTION

Figure 1:
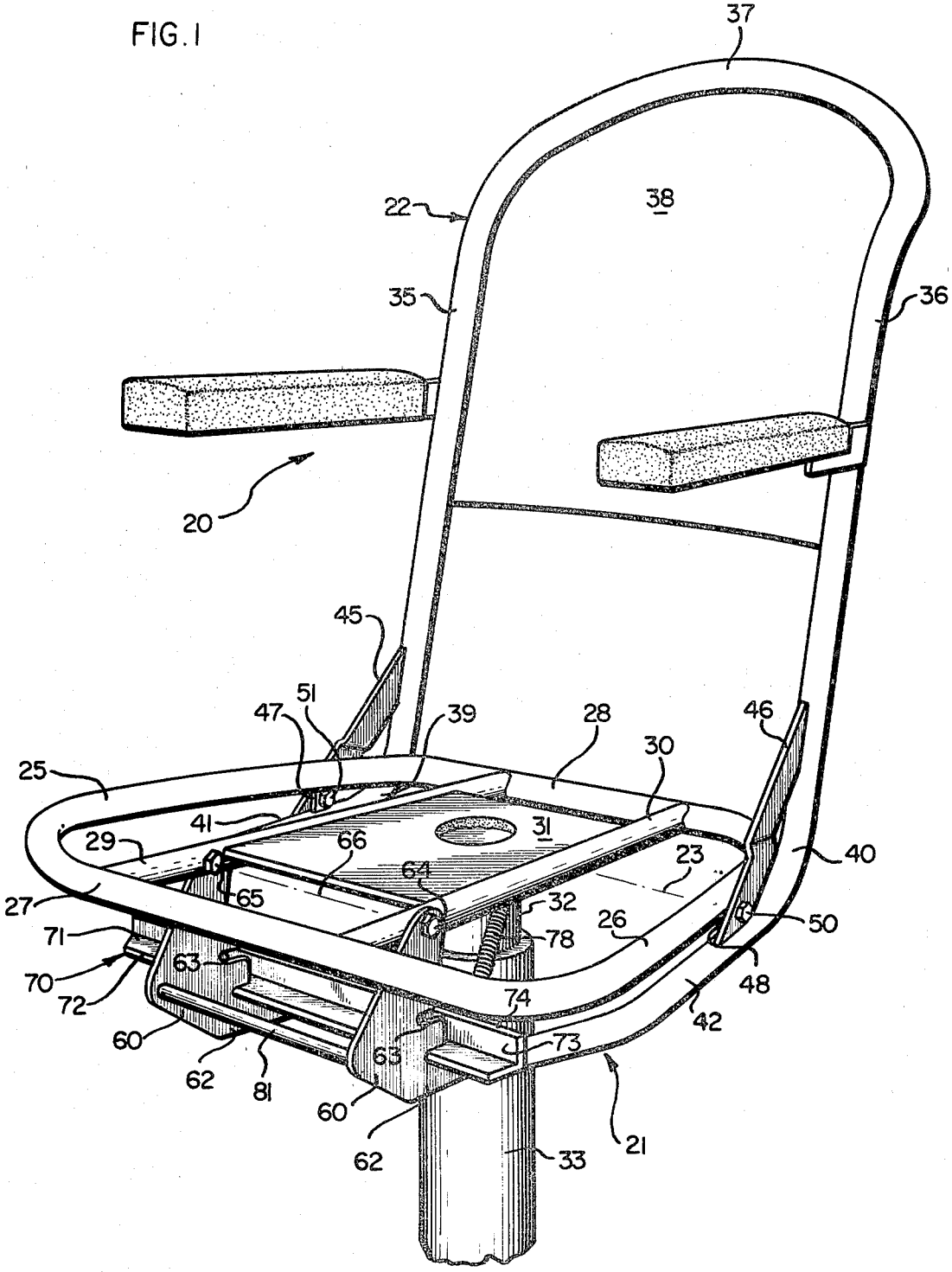
FIG. 1 is a perspective of a seat with adjustable back constructed in accordance with an embodiment of the present invention.
Figure 2:
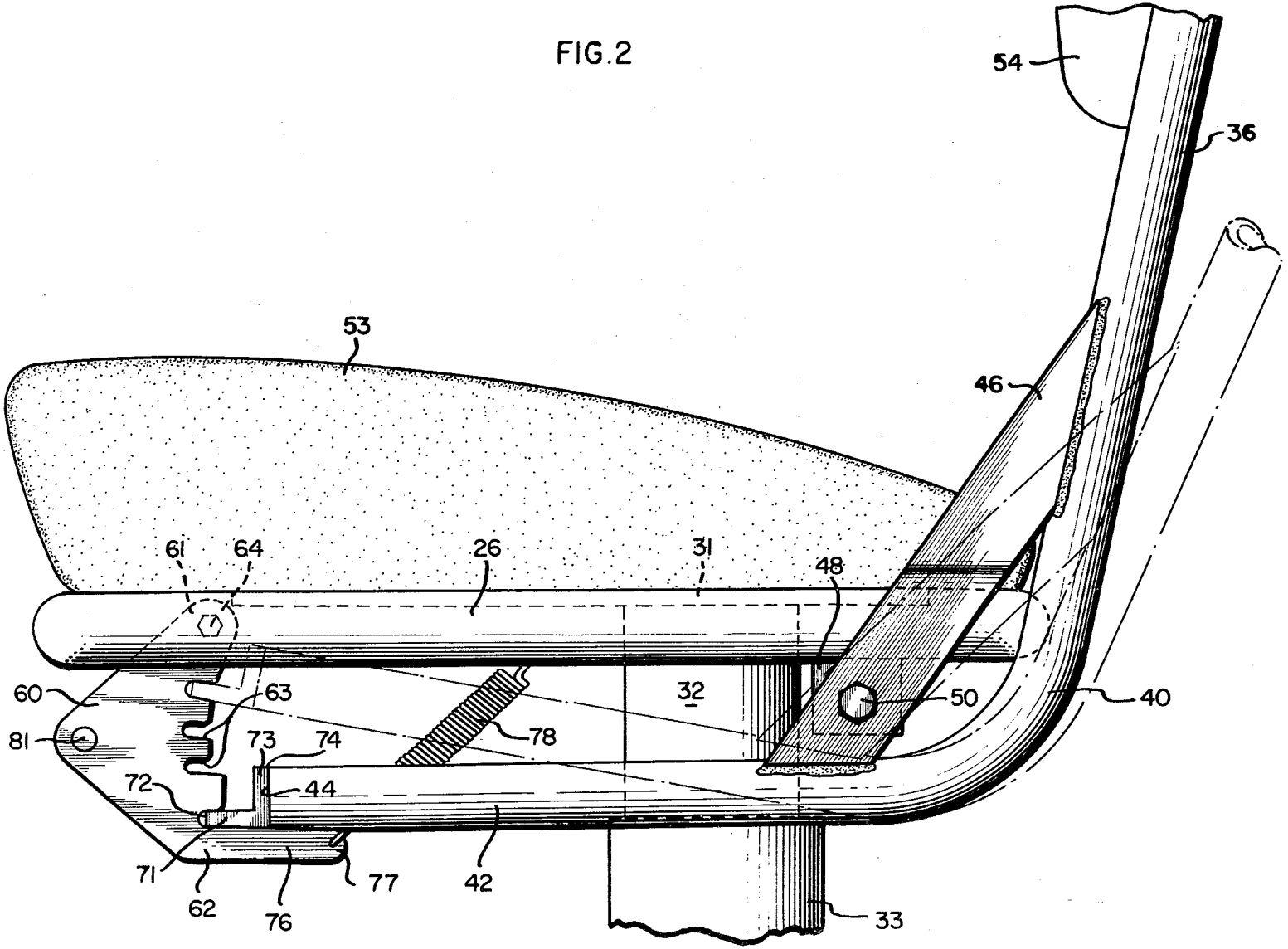
FIG. 2 is a fragmentary side elevational view of the seat of FIG. 1.
Figure 3:
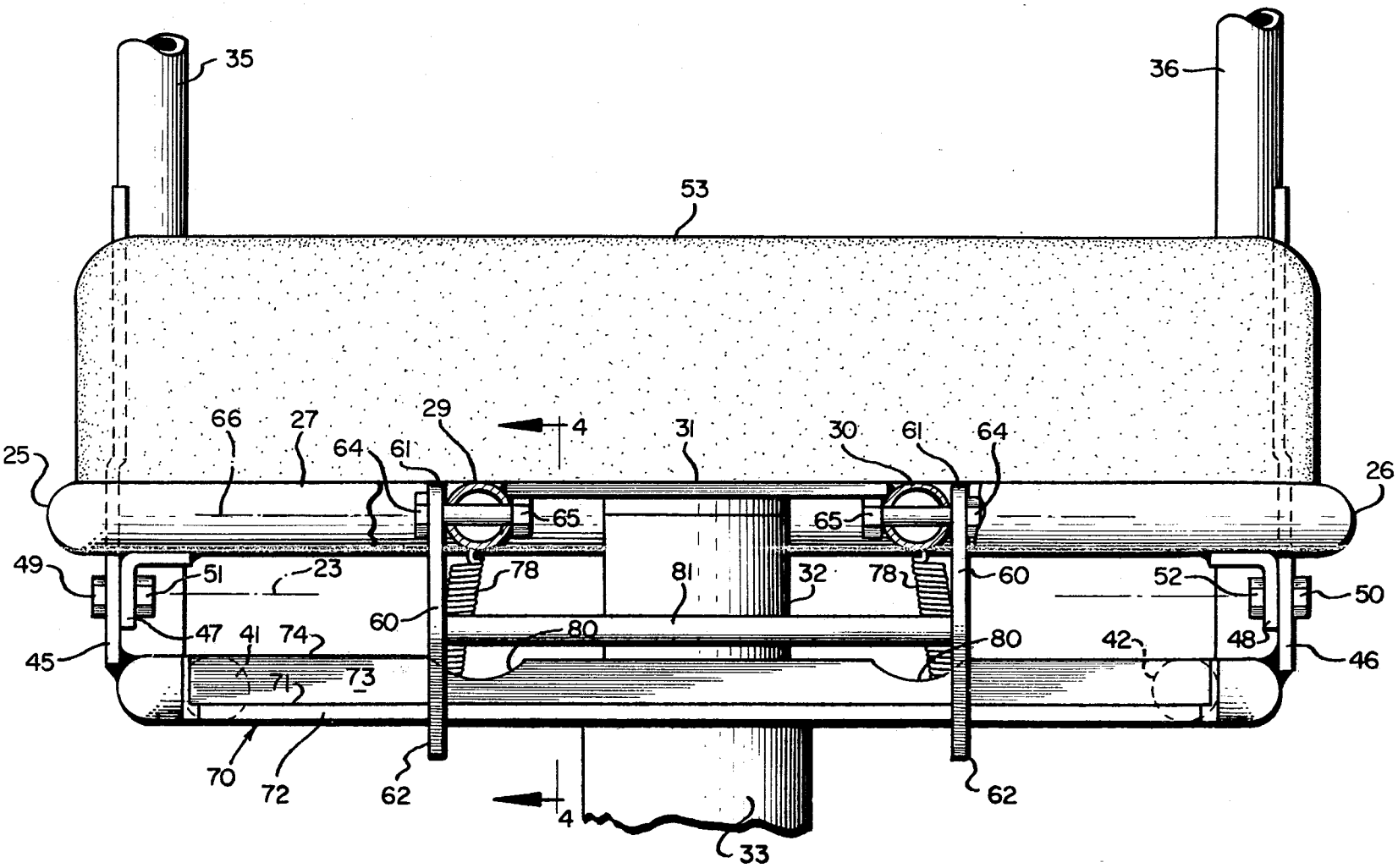
FIG. 3 is a fragmentary front view, partially cut away and partially in section, of the seat.

Referring initially to the embodiment illustrated in FIGS. 1–4, indicated generally at 20 is a seat having a seat frame 21 and a back frame 22 pivotally connected to the seat frame for movement about a first pivotal axis 23. Pivotal movement of back frame 22 about pivotal axis 23 adjusts the angle of tilt of back frame 22 relative to seat frame 21, and back frame 22 may be locked in any one of several tilted positions by structure to be subsequently described. Supported atop seat frame 21 is a seat cushion 53, and mounted on back frame 22 is a back cushion 54 (FIG. 2).

Seat frame 21 comprises a pair of side members 25,26 between which extend a front member 27 and a rear member 28. Front and rear members 27,28 define the front and rear ends of the horizontally disposed seat frame. Extending between front and rear members 27,28 are a pair of brace members 29,30. Secured between brace members 29,30 is a plate 31 resting atop a trunnion element 32 mounted on a pedestal 33.

Back frame 22 comprises a pair of side members 35,36. Extending between side members 35,36 at the upper end of each is a top portion 37 defining the upper end of the back frame. Also extending between side members 35,36 is a back plate 28. Side members 35,36 have respective bottom ends 39,40 from which project respective forwardly extending members 41,42 each terminating at a respective forward end 43,44 located in front of first horizontal pivotal axis 23. Extending from side members 35,36, near the bottom end of each, to forwardly extending members 41,42, near the rear of each, are diagonal braces 45,46. Depending from seat frame side members 25,26, near the rear end of each, are respective brackets 47,48. Extending through aligned openings in diagonal braces 45,46 and brackets 47,48 are a pair of bolts 49,50 secured in place by nuts 51,52. The axes of bolts 49,50 lie along first horizontal pivotal axis 23, and the connection of braces 45,46 to brackets 47,48 with bolts 49,50 mounts back frame 22 for pivotal movement about first horizontal pivotal axis 23.

Located near seat frame front member 27 are a pair of latch plates 60,60 each having respective upper and lower ends 61,62. Located between latch plate upper and lower ends 61,62 and facing rearwardly are a plurality of notches 63,63.

Extending through aligned openings in the upper end 61 of each latch plate 60 and a corresponding brace member 29 or 30 on seat frame 21 are bolts 64,64 secured in place by nuts 65,65. The structure described in the preceding sentence pivotally connects each latch plate 60,60, adjacent its upper end 61, to seat frame 21, forwardly of first horizontal pivotal axis 23, and mounts each latch plate for movement about a second horizontal pivotal axis 66 extending from side to side on the seat. Second horizontal pivotal axis 66 is located in front of and above first horizontal pivotal axis 23.

Extending between the forward ends 43,44 of forwardly extending members 41,42 is a cross member or bar 70 having an L-shaped cross section. Cross member 70 has a substantially horizontally disposed flange 71 terminating at a free end 72 and a substantially vertically disposed flange 73 terminating at a free end 74. Flange 71 with free end 72 engages within notches 63 on latch plate 60 to lock the back frame against pivotal movement about first horizontal pivotal axis 23. Extending rearwardly from the bottom end 62 of each latch plate 60 is a projection 76. Rearwardly extending projection 76 terminates at a free end 77 to which is connected the front end of a coil spring 78 having a rear end connected to a seat frame brace member 29 or 30 above and behind projection 76 on latch plate 60. The structure described in the preceding sentence normally urges latch plate 60 in a pivotal direction towards cross bar 70 to releasably engage an individual notch 63 with flange 71 on a cross bar 70.

Upper end 74 on flange 73 of the cross bar has a pair of grooves or notches 80,80 each located below a respective seat frame brace member 29,30. As back frame 22 is pivoted about first horizontal pivotal axis 23 in a clockwise sense (as viewed in FIG. 2), eventually grooves 80,80 abut against the bottom of brace members 29,30 to limit pivotal movement of the back frame in a clockwise sense. As back frame 22 pivots about first horizontal axis 23 in a counterclockwise sense (as viewed in FIG. 2), eventually the bottom of horizontal flange 71 or its free end 72 abuts against the top of rearwardly extending projection 76 on latch plate 60 to limit pivotal movement of back frame 22 in a counterclockwise pivotal sense.

The urging which coil spring 78 exerts on latch plate 60 normally holds notches 63 in a tight, relatively wiggle-free engagement with flange 71 of cross bar 70. This wiggle-free engagement is further enhanced by either tapering the flange adjacent its free end, as shown at 171 and 172 in FIG. 8 or inwardly tapering the notches as shown at 163 in FIG. 9.

Figures 4, 8, 9:
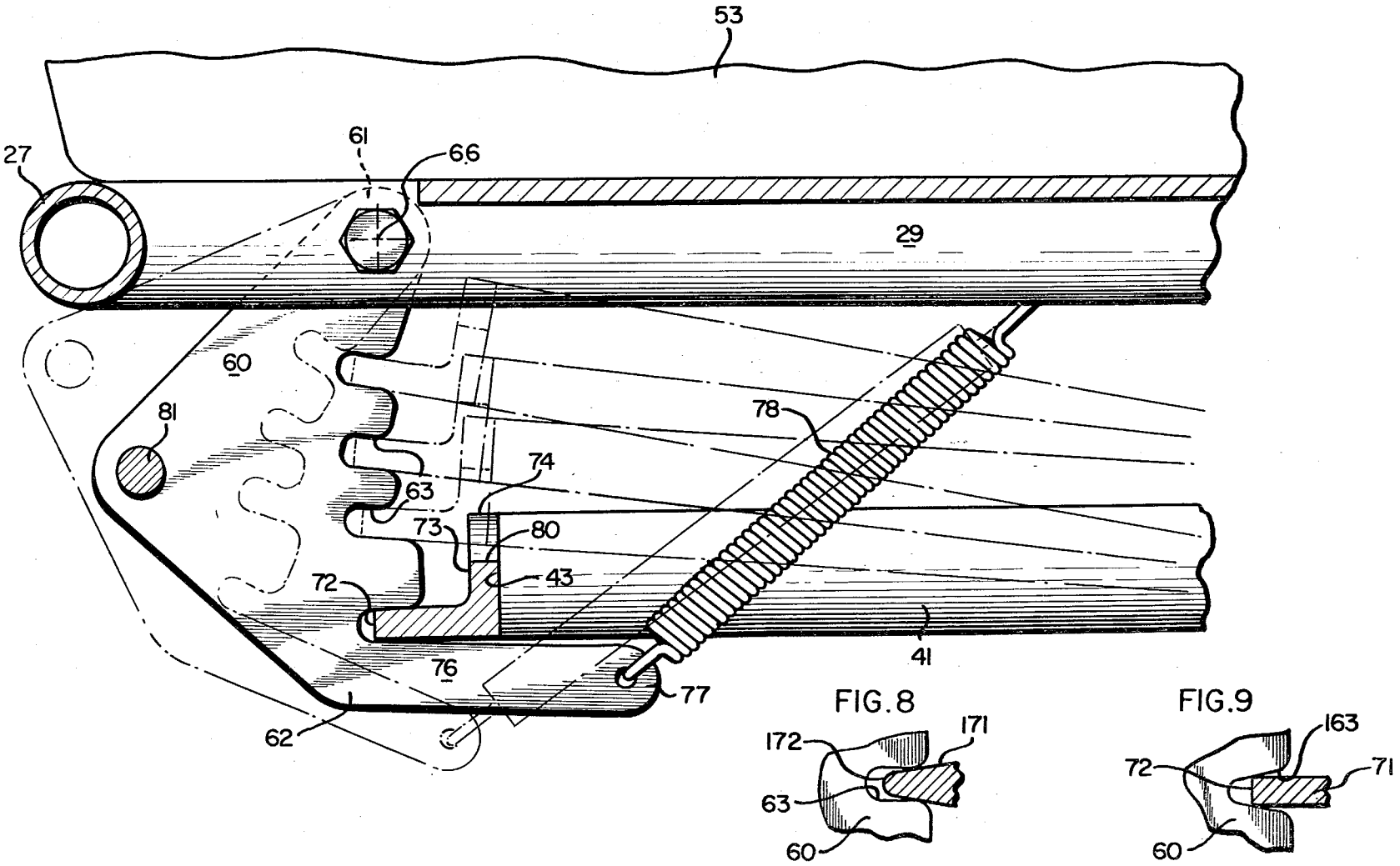
FIG. 4 is a sectional view taken along line 4—4 in FIG. 3.
FIG. 8 is a fragmentary sectional view showing one embodiment of a pair of latching elements for the adjustable seat back.
FIG. 9 is a fragmentary view showing another embodiment of a pair of latching elements.

The two latch plates 60,60 are connected together by a handle 81 which may be grasped to pivot the latch plates from an engaging position (FIG. 2 and solid lines in FIG. 4) to an unengaged position (dash-dot lines in FIG. 4). When handle 81 is released, the urging of springs 78 on latch plates 60,60 return the latch plates to their engaging position (FIG. 2 and full lines in FIG. 4). When latch plate 60 is pivoted to the unengaged position shown in dash-dot lines in FIG. 4, it abuts against seat frame front member 27 (in front of pivotal axis 66) to prevent further pivotal movement of the latch plate away from crossbar 70. The latch plate is then at a maximum displacement from its engaging position (solid lines in FIG. 4). When latch plate 60 is at this maximum displacement, projection 76 thereon is positioned to engage crossbar flange 71 to limit pivotal movement thereof in a counterclockwise sense as viewed in FIG. 4.

FIGS. 1-4 illustrate an embodiment in which back frame 22 has two members 41,42 extending forwardly from the bottom end of the back frame, a cross bar 70 extending between the two forwardly extending members 41,42, and a pair of latch plates 60,60.

Figure 5:
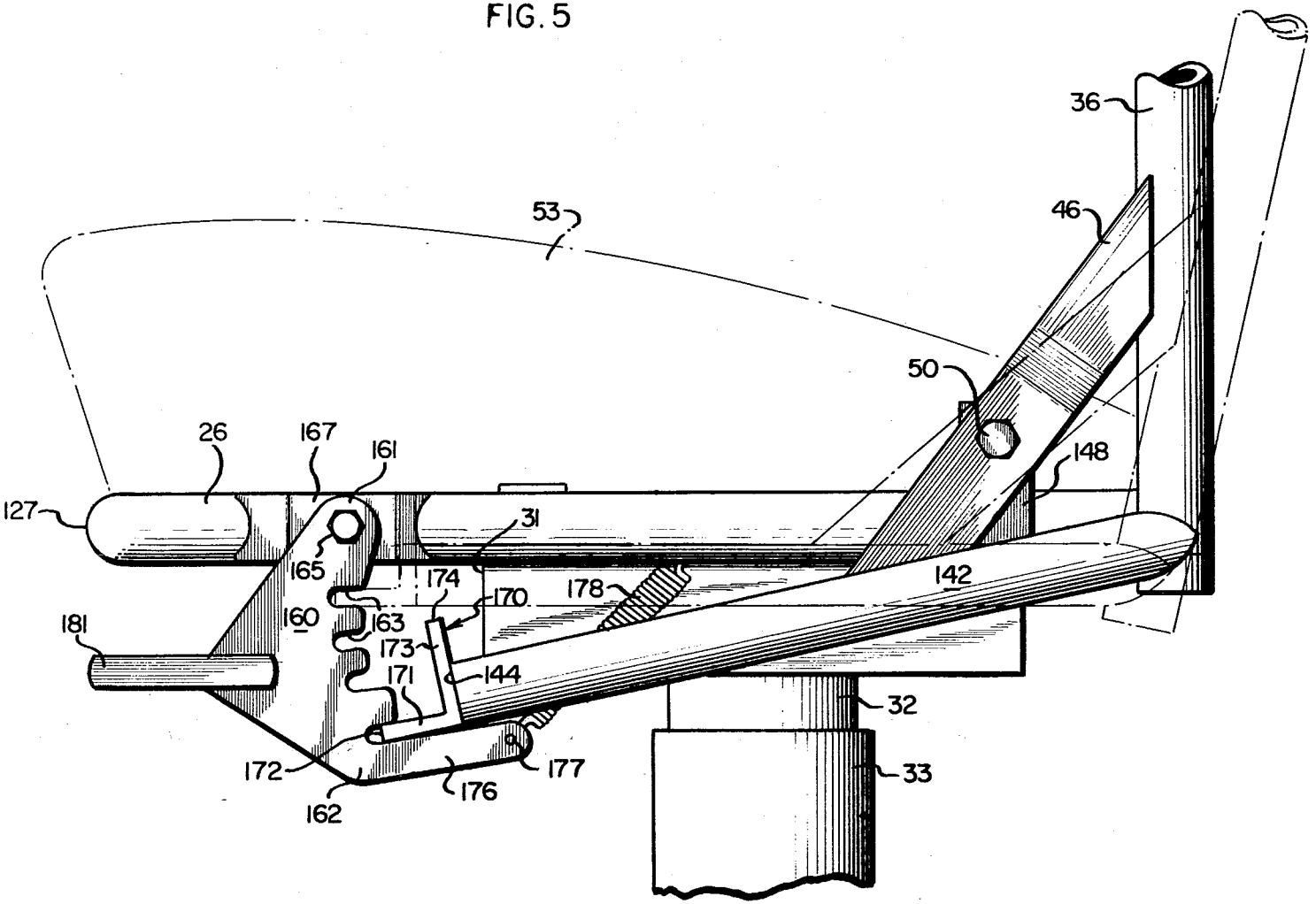
FIG. 5 is a fragmentary side elevational view of another embodiment of a seat constructed in accordance with the present invention.
Figure 6:
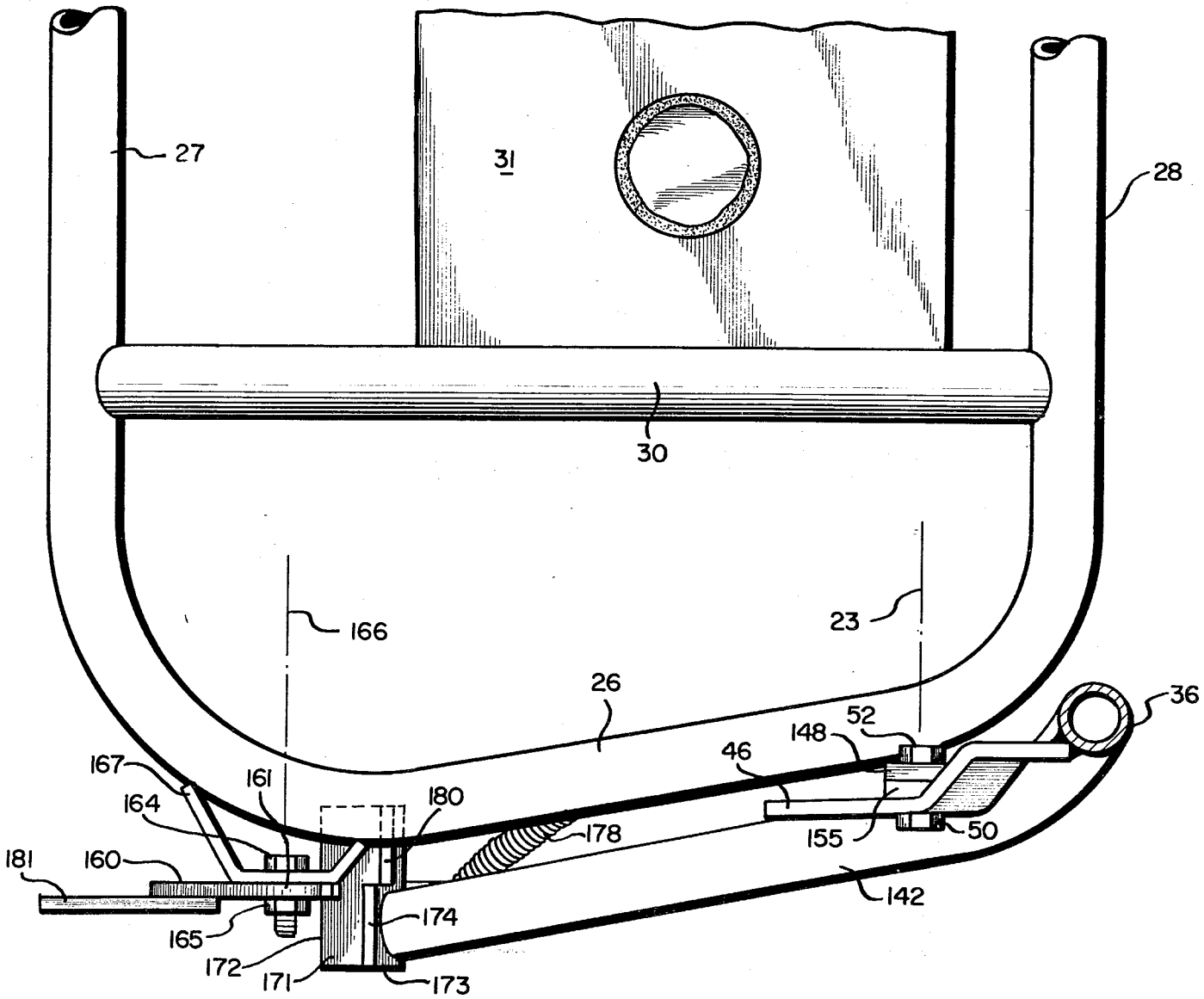
FIG. 6 is a plan view of the seat of FIG. 5.
Figure 7:
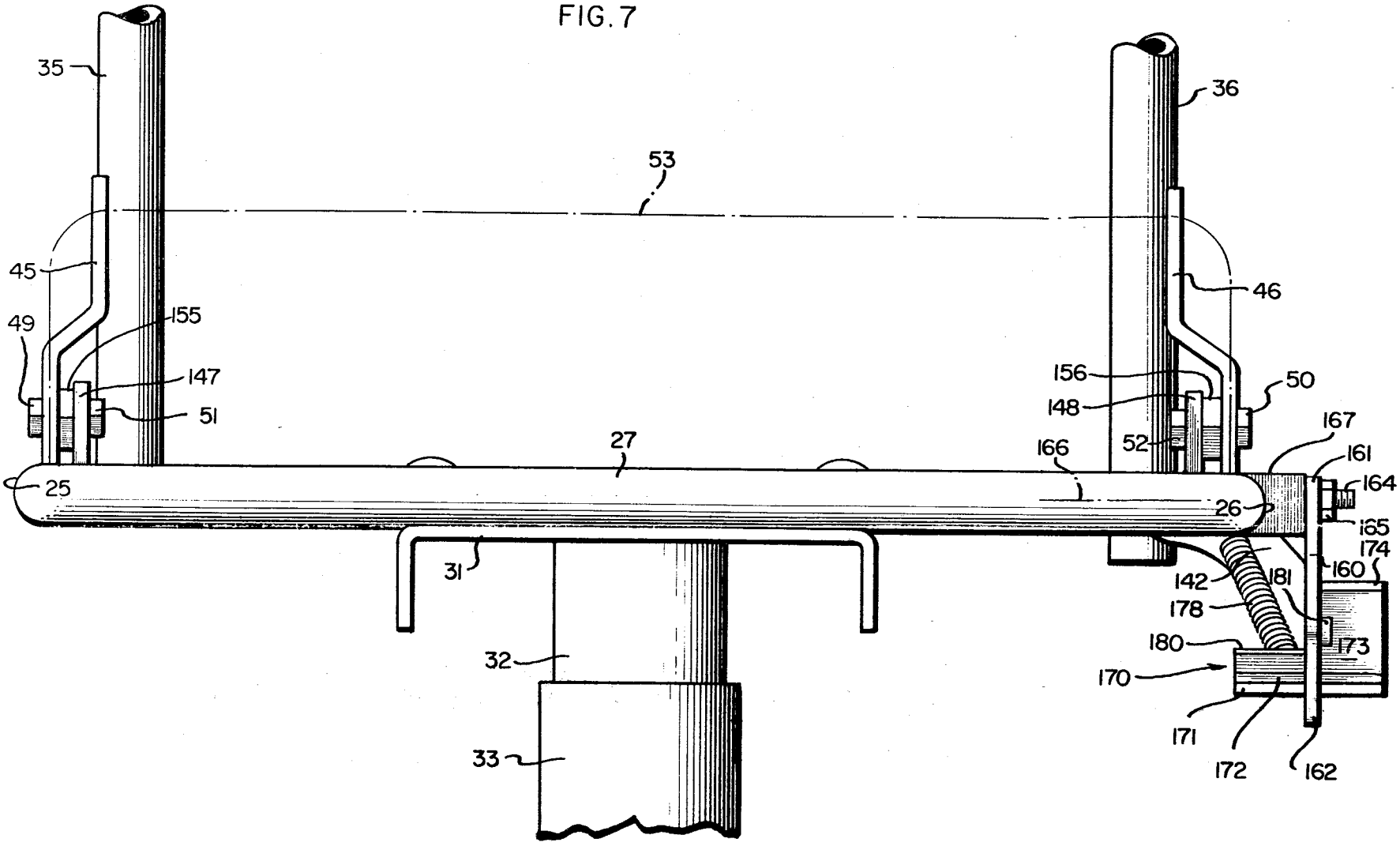
FIG. 7 is a front view of the seat of FIG. 5.

In the embodiment of FIGS. 5-7, the back frame has only a single forwardly extending member 142 terminating at a free end 144 to which is attached a notch-engaging element 170 having an L-shaped cross section comprising a horizontally disposed flange 171 terminating at a free end 172 and a vertically disposed flange 173 terminating at a free end 174. The embodiment of FIGS. 5-7 also comprises only a single latch plate 160 having respective upper and lower ends 161,162 with a plurality of notches 163 located therebetween. Latch plate 160 is pivotally connected by a bolt and nut 164,165 to a bracket 167 attached to side frame member 26 of seat frame 21, and the attachment described in the preceding part of this sentence mounts latch plate 160 for pivotal movement about a second horizontally disposed pivotal axis 166. Latch plate 160 has a rearwardly extending projection 176 terminating at a free end 177 connected to the lower end of a coil spring 178 having its upper end connected to seat frame side member 26 above and behind rearward projection 176 of the latch plate.

Vertical flange 173 of cross member 170 is cut away at 180, and cut-away 180 abuts against the bottom of seat frame side member 26 to limit pivotal movement of the back frame in a clockwise sense about axis 23 as viewed in FIG. 5. The bottom part of horizontal flange 171 abuts against the upper part of the latch plate's rearward projection 176 to limit pivotal movement of back frame 22 about axis 23 in a counterclockwise sense, as viewed in FIG. 5. Latch plate 160 has a handle 181 which is used to disengage the latch plate from cross bar 170.

The foregoing detailed description has been given for clearness of understanding only, and no unnecessary limitations should be understood therefrom, as modifications will be obvious to those skilled in the art.

I claim:

1. A seat with an adjustable back frame, said seat comprising:

a substantially horizontally disposed seat frame having front and rear ends;

a substantially vertically disposed back frame having top and bottom ends;

means pivotally connecting said back frame, adjacent its bottom end, to said seat frame adjacent the rear end of the latter, and mounting said back frame for movement about a first horizontal pivotal axis extending from side to side on said seat;

a pair of spaced-apart members, each extending from said back frame, adjacent the bottom end thereof, forwardly therefrom and each terminating at a respective forward end located in front of said first horizontal pivotal axis;

a pair of spaced-apart latch plates each having upper and lower ends and a plurality of notches therebetween;

means pivotally connecting each latch plate, adjacent its upper end, to said seat frame forwardly of said first horizontal pivotal axis, and mounting said latch plate for movement about a second horizontal pivotal axis extending from side to side on said seat;

a bar extending between the forward ends of said spaced-apart members, said bar comprising means for individually engaging the notches on each of said latch plates to lock said back frame against pivotal movement about said first horizontal pivotal axis;

means normally urging both of said latch plates in a pivotal direction toward said bar to releasably engage an individual notch on each plate with said notch-engaging means on sad bar;

a lower part on said bar;

a rearwardly extending projection at the bottom end of each latch plate;

means on the lower part of said bar for abutting against said rearwardly extending plate projections to limit pivotal movement of said back frame in one pivotal sense;

said pivotal connecting means for the latch plates comprising means mounting each latch plate for movement between an engaging position with said bar and an unengaged position of maximum displacement from said engaging position and at which said latch plate abuts against said seat frame at a location to the front of said second horizontal pivotal axis;

said rearwardly extending projections comprising means abuttable with said lower part of said bar when said latch plate is in said position of maximum displacement.

2. A seat as recited in claim 1 and comprising:

an upper part on said bar including means for abutting against said seat frame from below to limit pivotal movement of the back frame in another pivotal sense opposite said one pivotal sense.

3. A seat as recited in claim 1 wherein:

said rearwardly extending projection terminates at a free end;

and said urging means for the latch plates comprises a coil spring having a front end connected to said free end of said projection and a rear end connected to said seat frame above and behind said projection.

4. A seat with an adjustable back frame, said seat comprising:

a substantially horizontally disposed seat frame having front and rear ends and a pair of sides;

a substantially vertically disposed back frame having top and bottom ends and a pair of sides;

means pivotally connecting said back frame, adjacent its bottom end, to said seat frame adjacent the rear end of the latter, and mounting said back frame for movement about a first horizontal pivotal axis extending from side to side on said seat;

a member connected to one side of said back frame and having a forward portion located in front of said first horizontal pivotal axis;

a single latch plate having upper and lower ends and a plurality of notches therebetween;

means pivotally connecting said latch plate, adjacent its upper end, to said seat frame at one side thereof and forwardly of said first horizontal pivotal axis, and mounting said latch plate for movement about a second horizontal pivotal axis extending from side to side on said seat;

bar means at the forward portion of said member, said bar means having a horizontally disposed flange for individually engaging said notches on said latch plate to lock said back frame against pivotal movement about said first horizontal pivotal axis;

and means normally urging said latch plate in a pivotal direction towards said bar means to releasably engage an individual notch with said horizontally disposed flange;

and a vertically disposed flange on said bar means, said vertically disposed flange having a cut-away portion comprising means for abutting against the bottom of said seat frame, at said one side thereof, between said two horizontal pivotal axes, to limit said pivotal movement of said back frame in a first pivotal sense.

* * * * *

UNITED STATES PATENT AND TRADEMARK OFFICE

CERTIFICATE OF CORRECTION

PATENT NO. : 4,372,611
DATED : February 8, 1983
INVENTOR(S) : Lester H. Feddeler It is certified that error appears in the above-identified patent and that said Letters Patent are hereby corrected as shown below:

Col. 2, line 60, "28" should be --38--;

Col. 5, line 21, "sad" should be --said--.

Signed and Sealed this

*Twelfth* Day of *April 1983*

[SEAL]

*Attest:*

GERALD J. MOSSINGHOFF

*Attesting Officer*

*Commissioner of Patents and Trademarks*